US006920649B2

(12) United States Patent
Oury

(10) Patent No.: US 6,920,649 B2
(45) Date of Patent: Jul. 26, 2005

(54) FLUSHING MECHANISM FOR TOILET TANK

(75) Inventor: Jean-Claude Oury, Artas (FR)

(73) Assignee: Societe Etex de Recherches Techniques, Sert, Vernouillet (FR)

( * ) Notice: Subject to any disclaimer, the term of this patent is extended or adjusted under 35 U.S.C. 154(b) by 23 days.

(21) Appl. No.: 10/466,852

(22) PCT Filed: Jan. 22, 2002

(86) PCT No.: PCT/FR02/00241

§ 371 (c)(1),
(2), (4) Date: Dec. 19, 2003

(87) PCT Pub. No.: WO02/059431

PCT Pub. Date: Aug. 1, 2002

(65) Prior Publication Data

US 2004/0083542 A1 May 6, 2004

(30) Foreign Application Priority Data

Jan. 23, 2001 (FR) ..... 01 00863

(51) Int. Cl.[7] ..... E03D 1/14; E03D 3/12
(52) U.S. Cl. ..... 4/325; 4/390
(58) Field of Search ..... 4/324–325, 390

(56) References Cited

U.S. PATENT DOCUMENTS

| | | | | | |
|---|---|---|---|---|---|
| 5,659,903 | A | * | 8/1997 | Hammarstedt | 4/325 |
| 2002/0112282 | A1 | * | 8/2002 | Han et al. | 4/325 |
| 2003/0131403 | A1 | * | 7/2003 | Ho | 4/325 |

FOREIGN PATENT DOCUMENTS

| | | |
|---|---|---|
| EP | 0 578 892 | 1/1994 |
| EP | 0 915 210 | 5/1999 |
| WO | WO 97 05337 | 2/1997 |

* cited by examiner

*Primary Examiner*—Charles E. Phillips
(74) *Attorney, Agent, or Firm*—Young & Thompson

(57) ABSTRACT

A flushing mechanism for toilet tank comprises an overflow tube (1) provided with a sealing valve (3, 4) co-operating with a discharge orifice (5') including a first floater (30) mounted on a height-adjusting screw (31) and a second floater (40) mounted pivoting about a fixed pin (41). The adjusting screw (31) is articulated (33) on a lever (34) articulated about a fixed pin (35), the lever (34) is provided with a snug (36) co-operating with a first locking cam (37) and the second floater (40) is provided with a snug (42) co-operating with a second locking cam (43). The invention is applicable to double-volume flushing systems.

12 Claims, 15 Drawing Sheets

Figure 1:
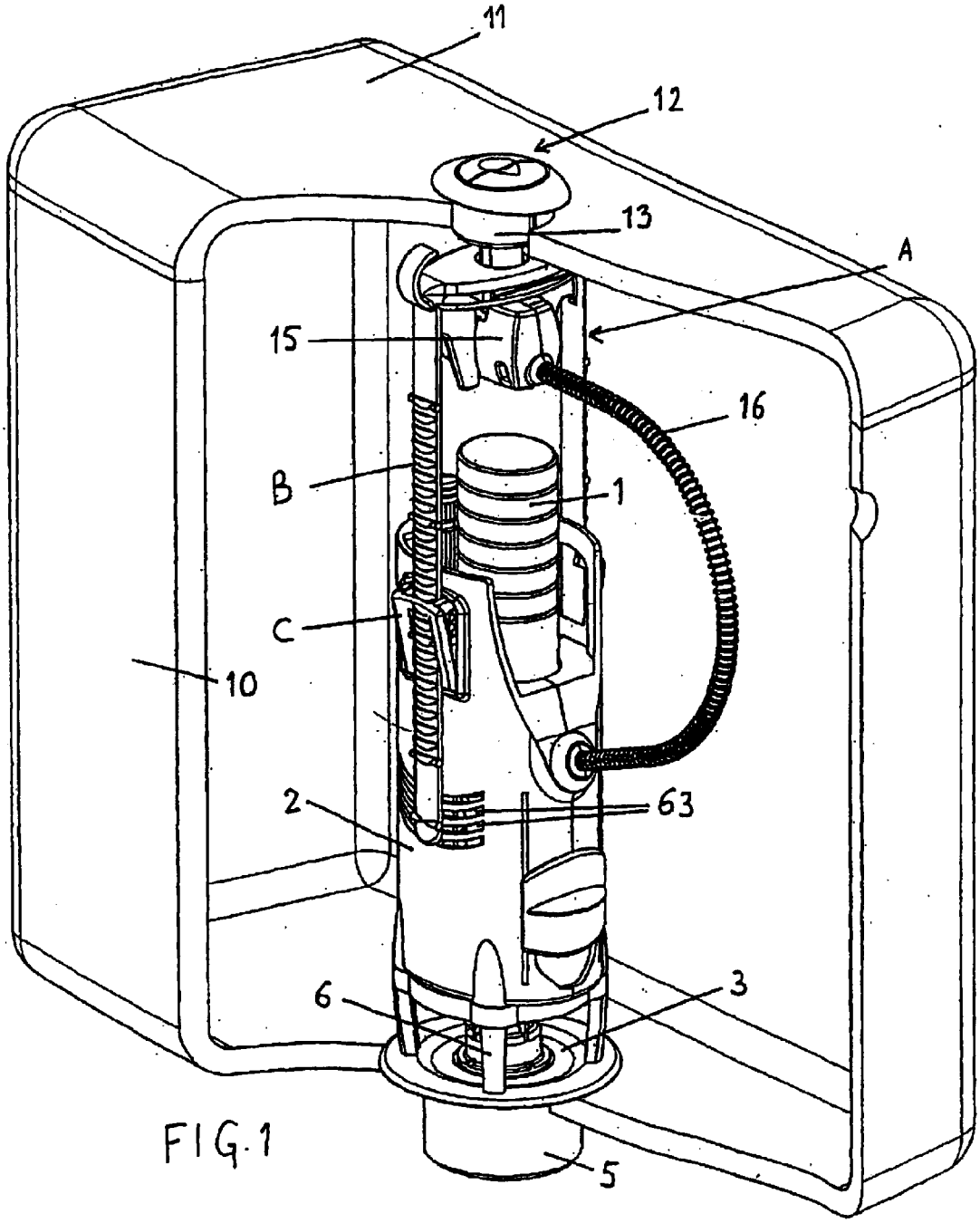

11
70
73
A
10
72
15
1
2
78
71
C
B

FLUSHING MECHANISM FOR TOILET TANK

The invention relates to a flushing mechanism for toilet tanks arranged to permit evacuation, from a previously filled tank, into the toilet bowl, of two different volumes of water by action on at least one control button, said mechanism being surrounded by an housing and comprising an overflow tube provided, at its lower end, with a sealing valve coacting with an evacuation opening provided in the bottom of the tank, said overflow tube being arranged to occupy at least three axial positions, namely a lower position for closing the evacuation opening, an intermediate so-called small flush position permitting evacuation of a first volume of water and an upper so-called large flush position permitting the evacuation of a second volume of water greater than the first volume of water, control means ensuring the axial movement of the overflow tube from its lower position to its intermediate or upper position, the mechanism comprising moreover a first so-called small flush float mounted on a height adjustment screw and a second so-called large flush float mounted pivotally about a fixed axis relative to the housing. So as to save water, which is costly and precious, there have been developed, for toilet tanks, flush mechanisms permitting the evacuation, at the choice of the user, of two different volumes of water.

These "double flush" mechanisms, like certain of the usual single flush mechanisms, comprise in general an overflow tube movable in vertical translation within an housing, the lower end of the overflow tube forming a sealing valve between the tank and the toilet bowl. The movement of the overflow tube is controlled by at least one control button acting on a transmission. Two floats, a so-called large flush float and the other a so-called small flush float, determine the volume of water respectively evacuated when the water level in the tank reaches the respective float, which frees the overflow tube, which re-descends to close the communication between the tank and the bowl. The adjustment of the volume of water evacuated in a small flush can be obtained by adjustment of the height position of the small flush float relative to the level of water in the tank.

Numerous proposals have been put forth for such mechanisms, with various solutions essentially for the transmission between the control button or buttons and the overflow tube and the manner of co-action between the floats and the overflow tube. There could be cited, among other documents, WO 97/17503, FR 2 770 547 or FR 2 720 421. The known solutions of the prior art are not totally satisfactory as to safety and durability of operation, as to access for maintenance and repair, as to ease of mounting and/or adjustment, and as to the size and/or maintenance of a reserve of water.

Moreover, the costs of these known mechanisms are relatively high because they need the assembly of a relatively large number of constituent pieces.

There is known from EP 0 915 210 (U.S. Pat. No. 6,094,753), a flushing mechanism corresponding to the state of the art described above. This known mechanism has the drawback of using a lever transmission, disposed within the overflow tube, and hence difficult to access and cumbersome. Moreover, the large flush float is held by a mechanical lock which is released by direct action of the small flush float, which constitutes a cause of wear and a risk of malfunction. Moreover, the assembly of the mechanism has a size, in particular a height, which is great.

The present invention accordingly seeks to provide a new double flush mechanism for toilet tanks, which does not have the drawbacks of the above mechanisms.

To this end, the mechanism according to the invention is characterized in that the adjustment screw is articulated, adjacent its lower end, on one end of a lever whose other end is articulated about an axle fixed relative to the housing, said lever is provided with a lug that coacts, in the course of movement of said overflow tube from its lower position to its intermediate position, with a first cam carried by the external surface of said overflow tube and the second large flush float is provided with a lug coacting, in the course of the movement of said overflow tube between its intermediate position and its upper position, with a second cam carried by said overflow tube and farther from the sealing valve than the first cam.

The mechanism according to the invention offers the advantage of certain operation, even with a minimum water level in the tank. If construction permits reducing the height-wise size of the mechanism and its overall cost.

Preferably, the overflow tube comprises a lateral shoulder, with which a lever coacts that pivots about an axis orthogonal to the direction of movement of the overflow tube, said lever being controlled in rotation by a cable within a sheath whose one end is fixed to said lever and whose other end is fixed to a slide controlled according to two different paths by a control button with two positions.

The transmission by sheathed cable between the control button and the pivoting lever permits a simple, economical, reliable and small structure which moreover permits mounting of the flushing mechanism as desired with or without securement of the cover on the tank.

Figure 2:
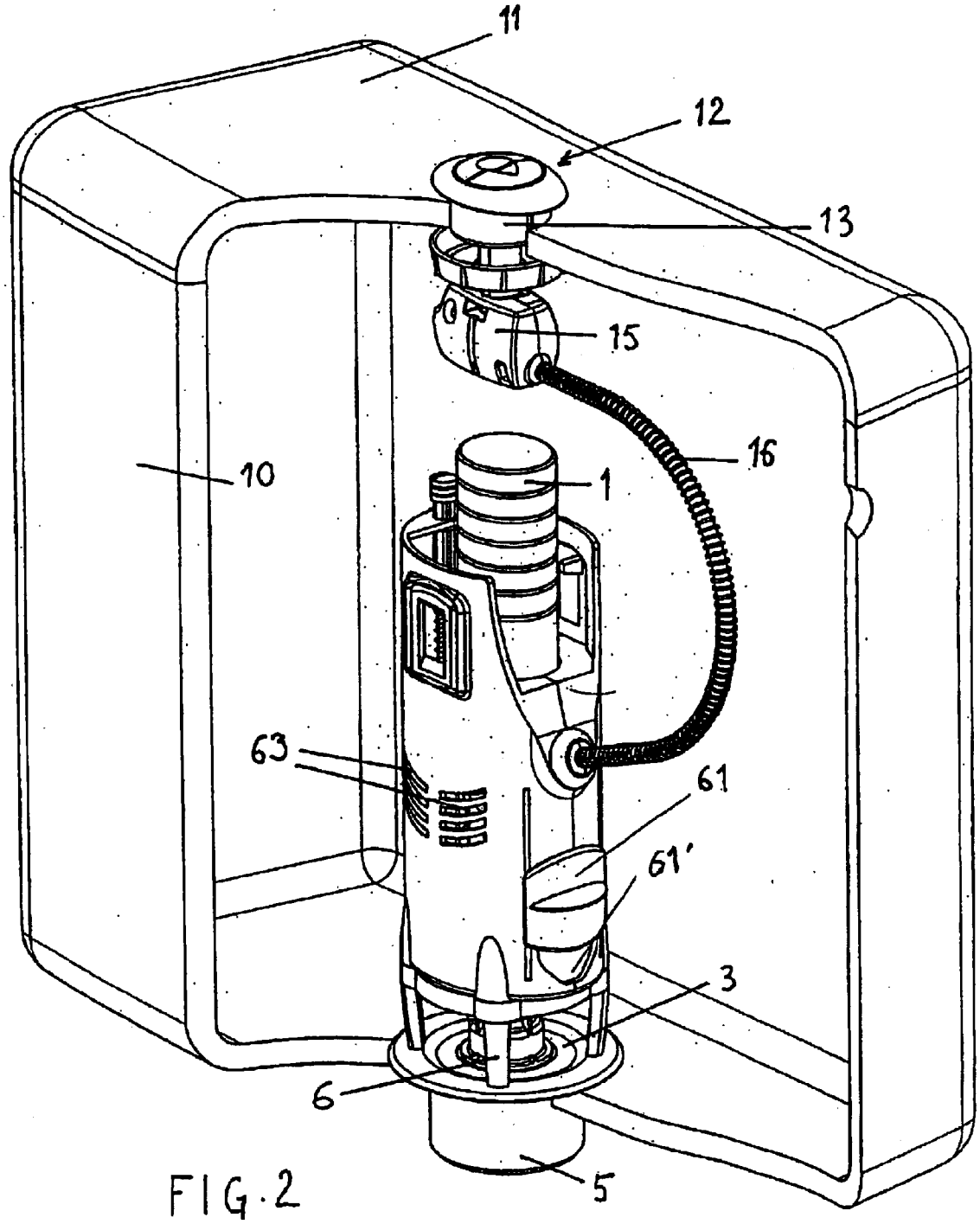
Figure 3:
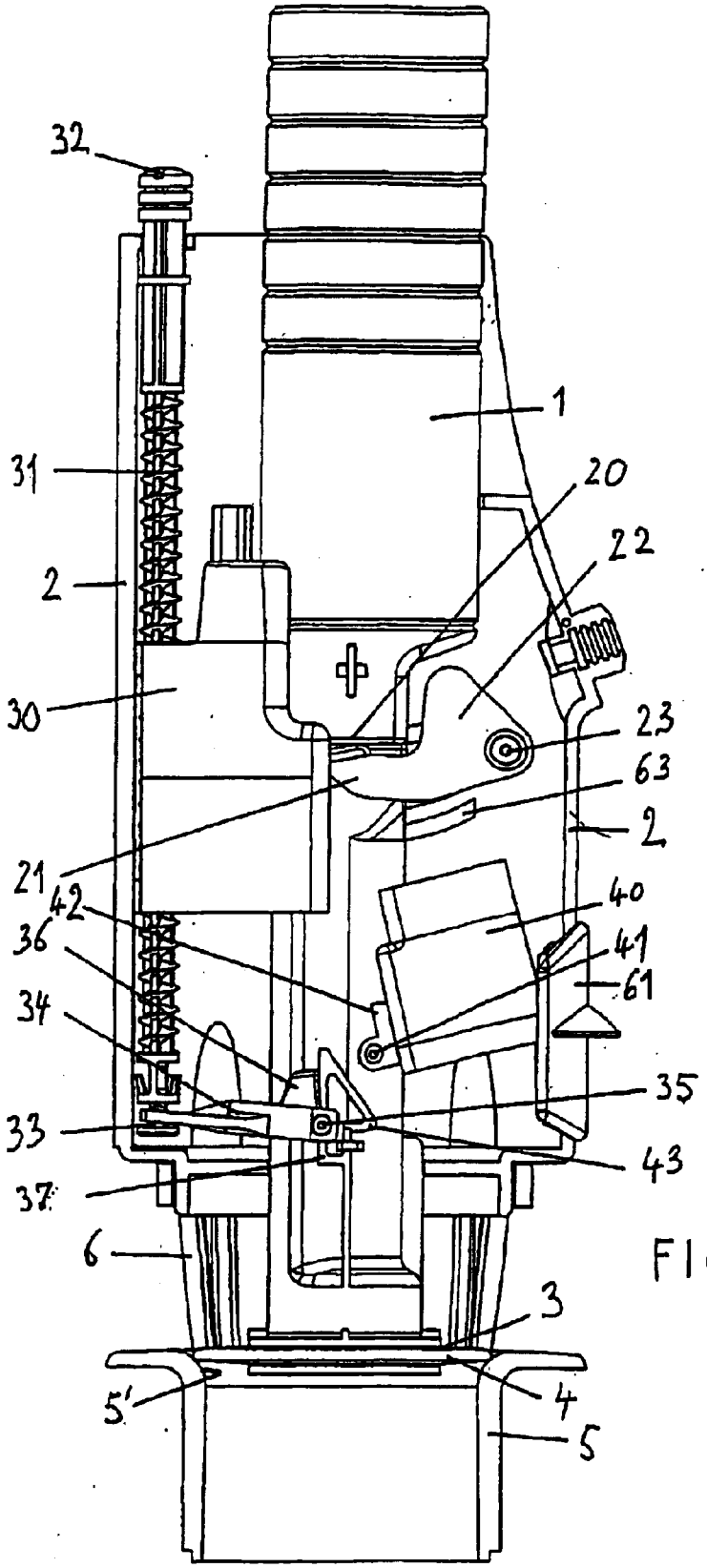
Figure 4:
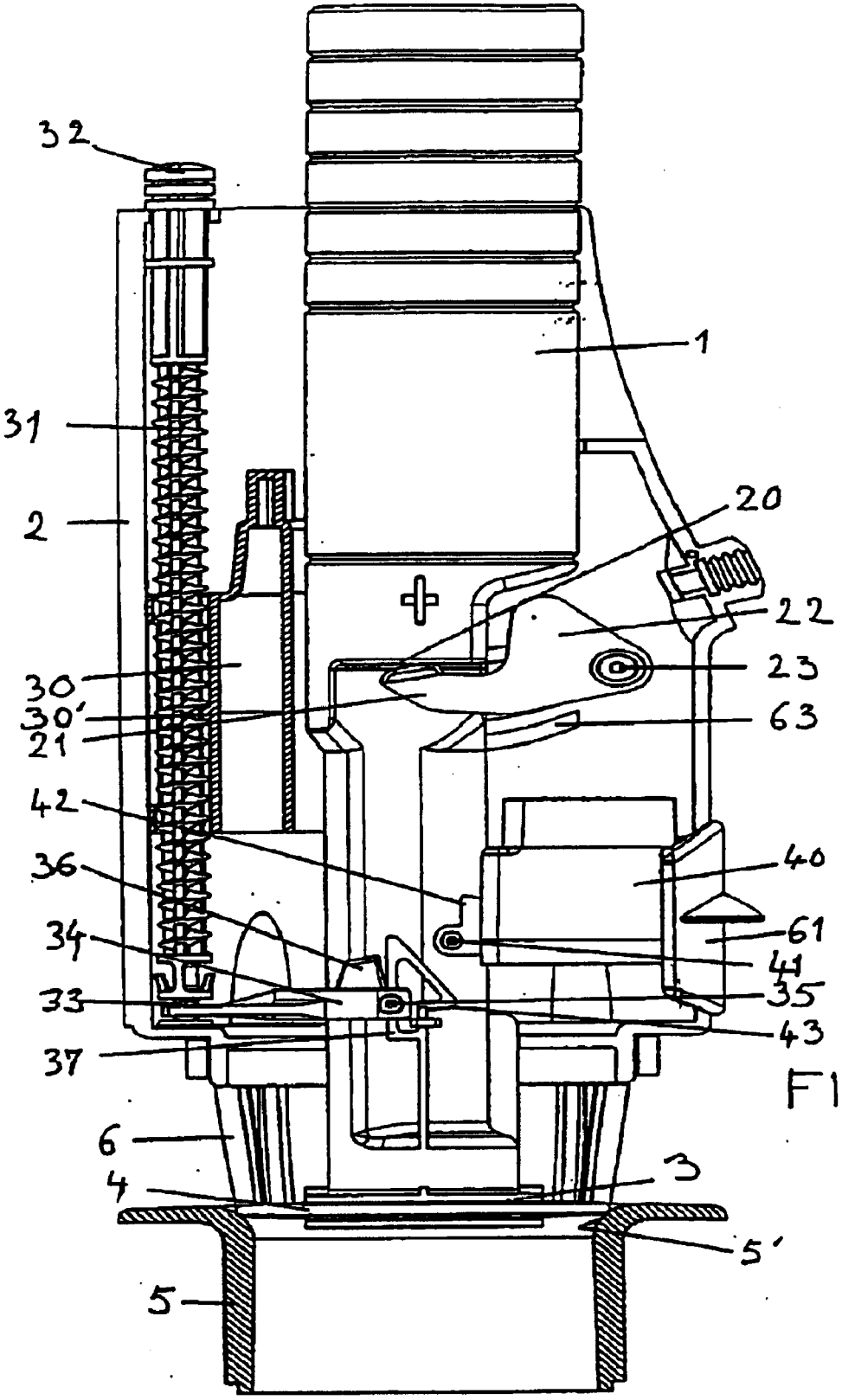
Figure 5:
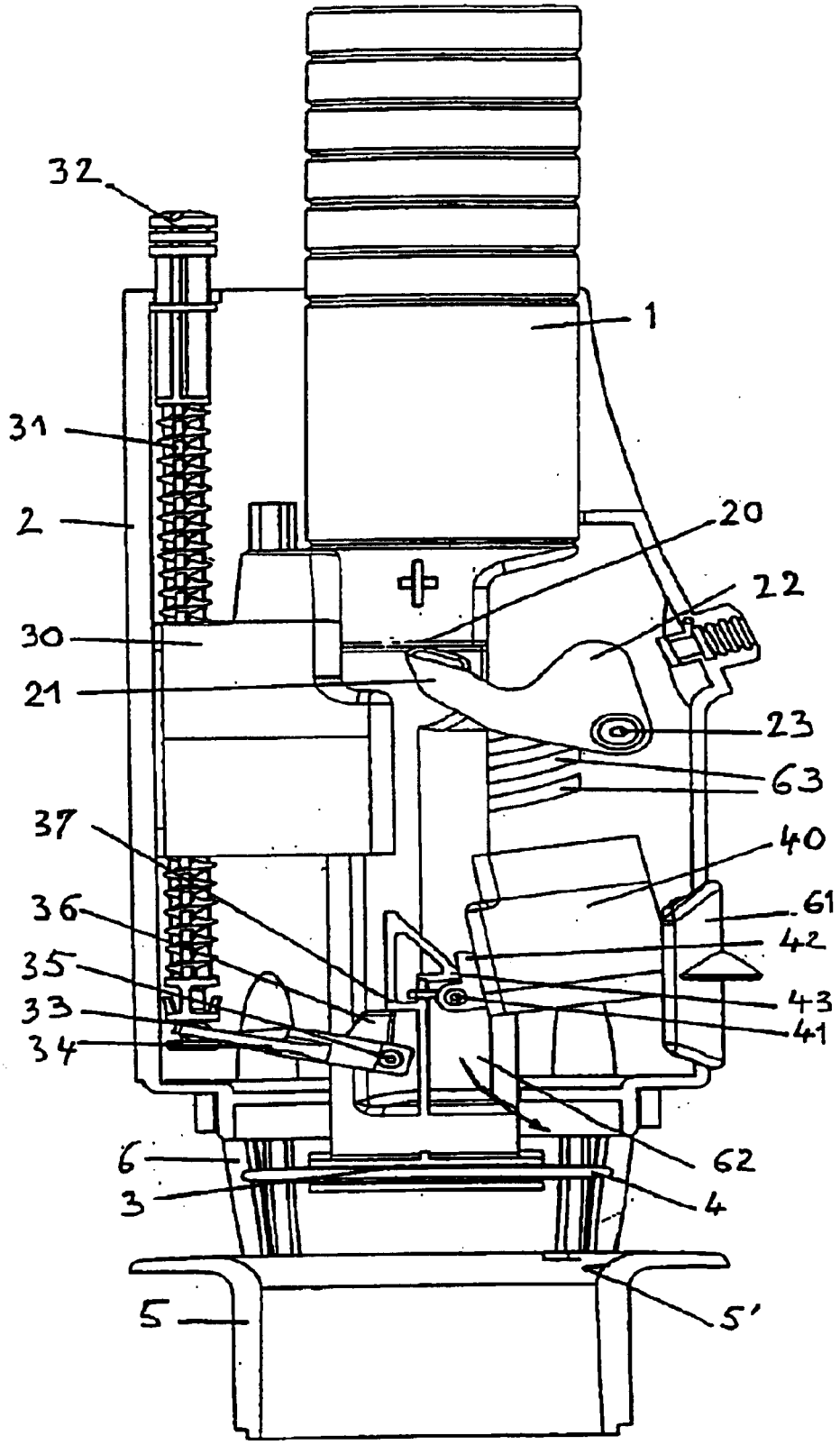
Figure 6:
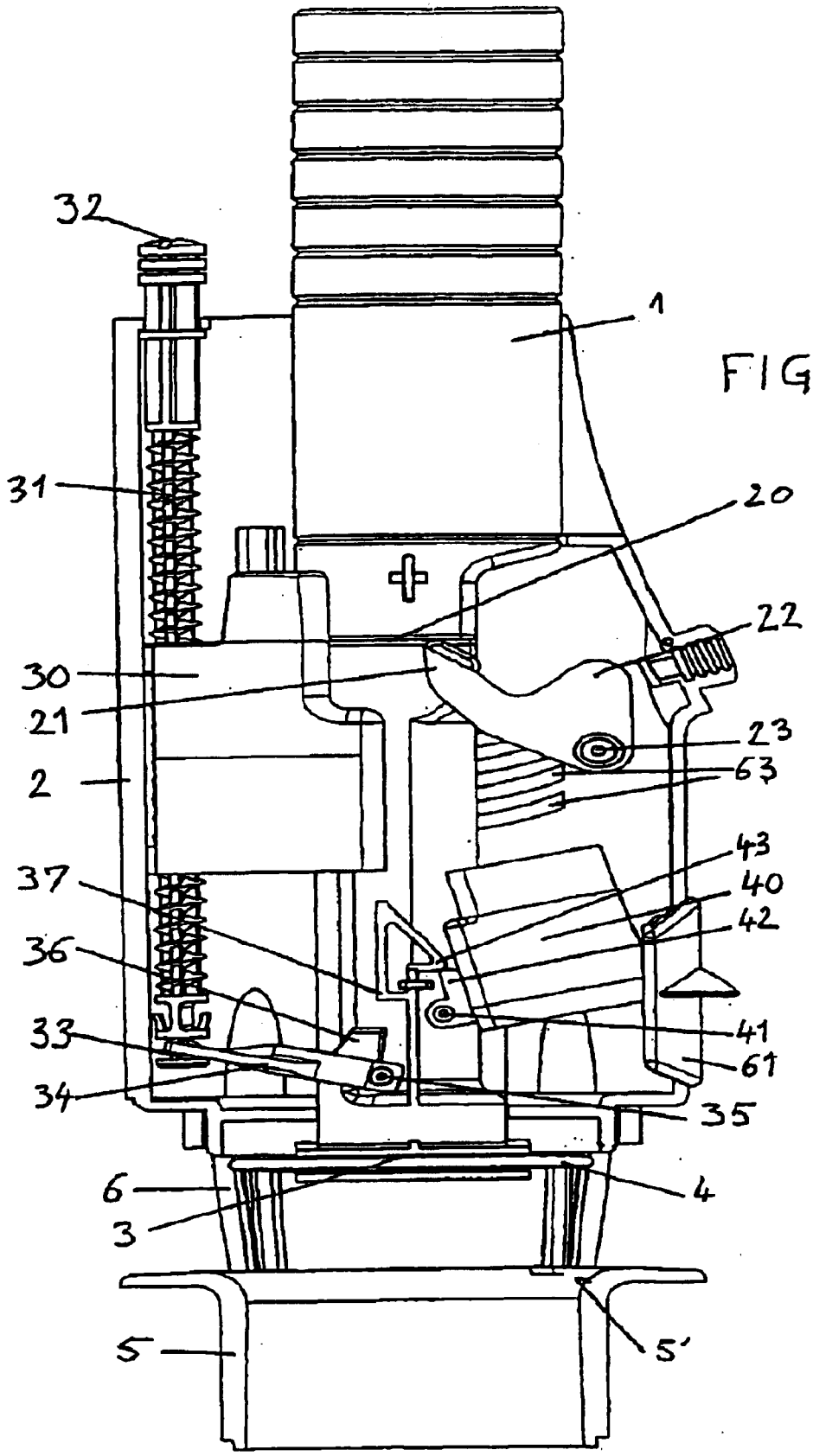
Figure 7:
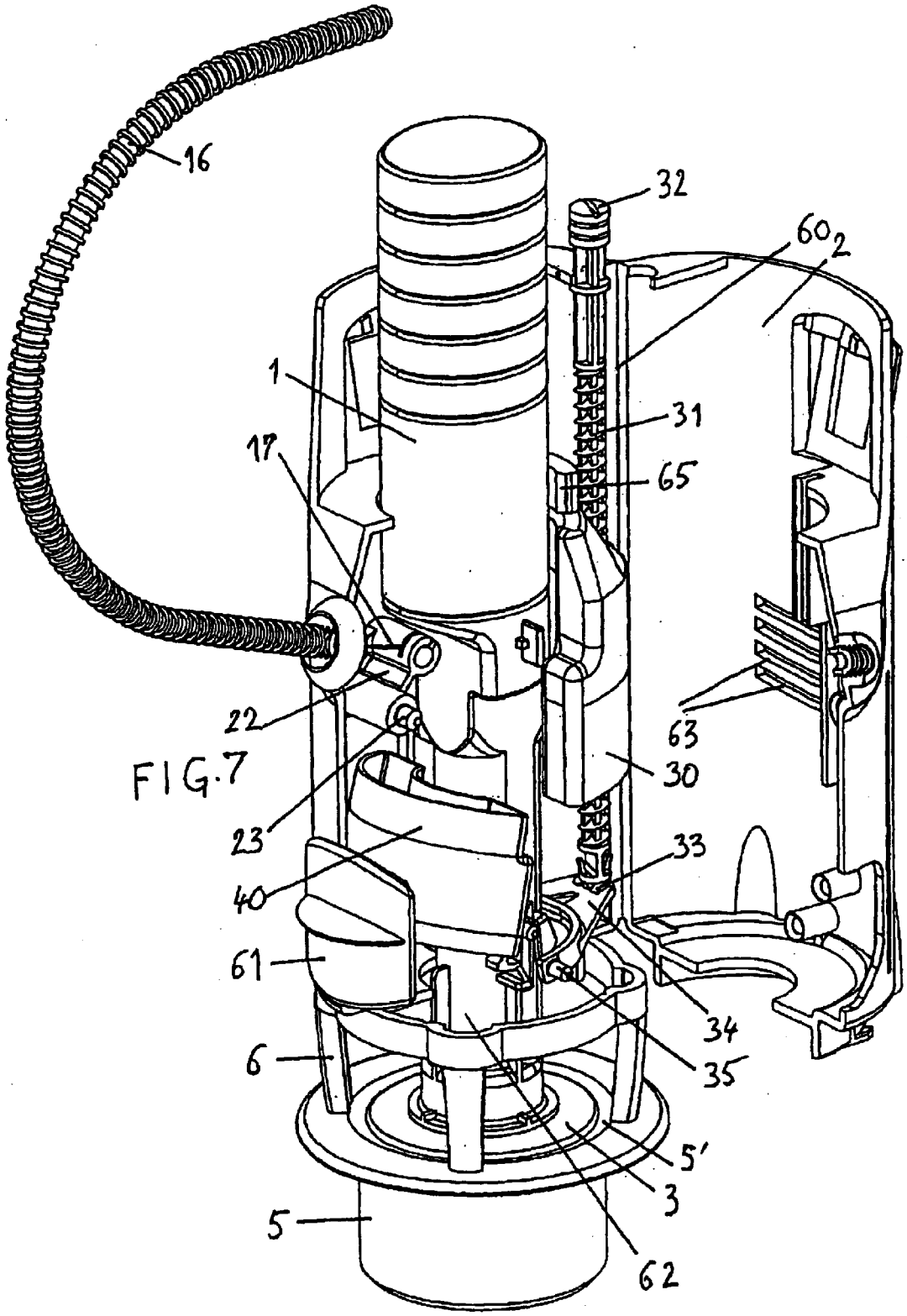
Figure 8:
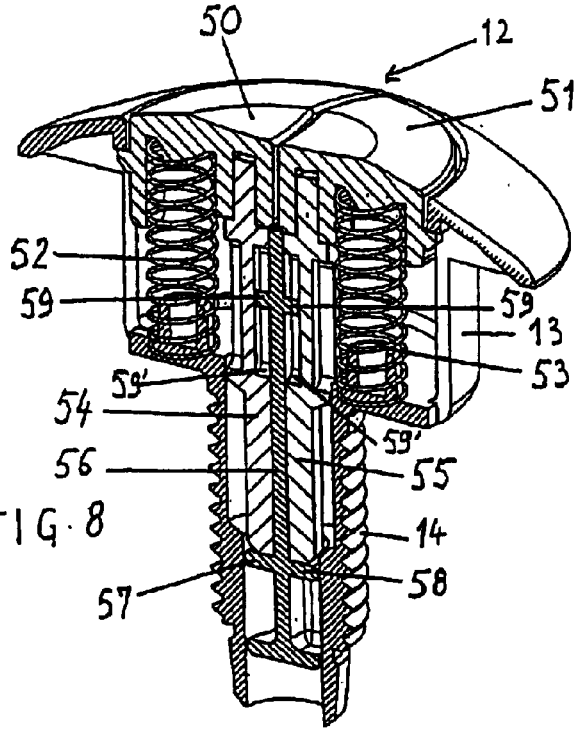
Figure 9:
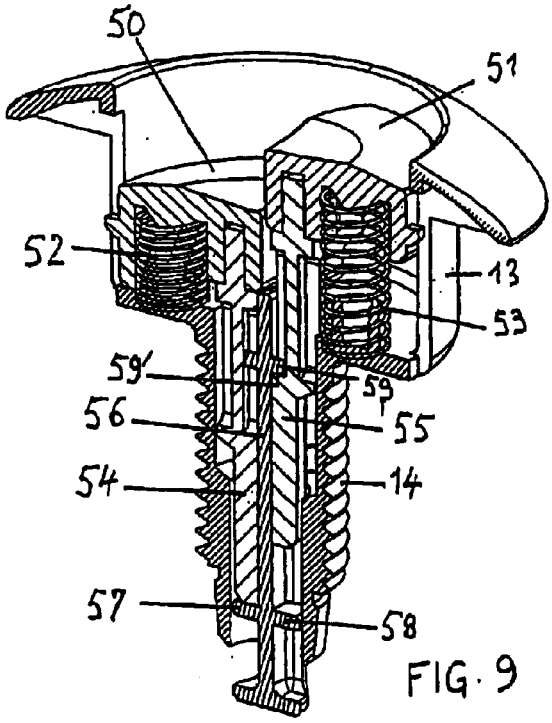
Figure 10:
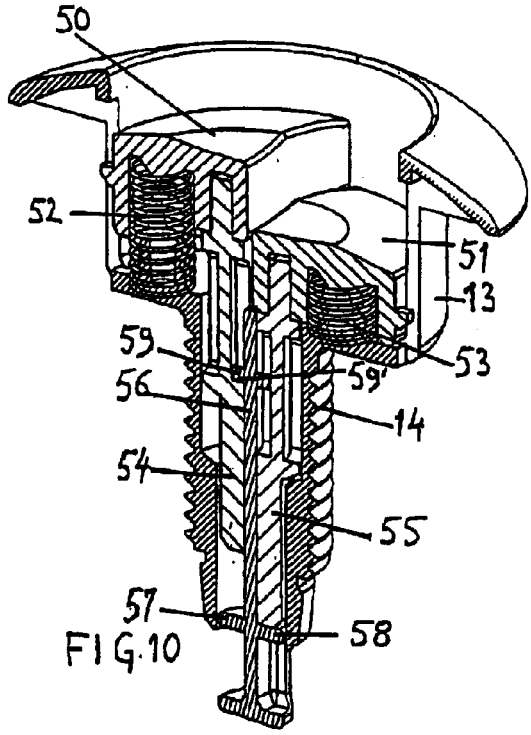
Figure 11:
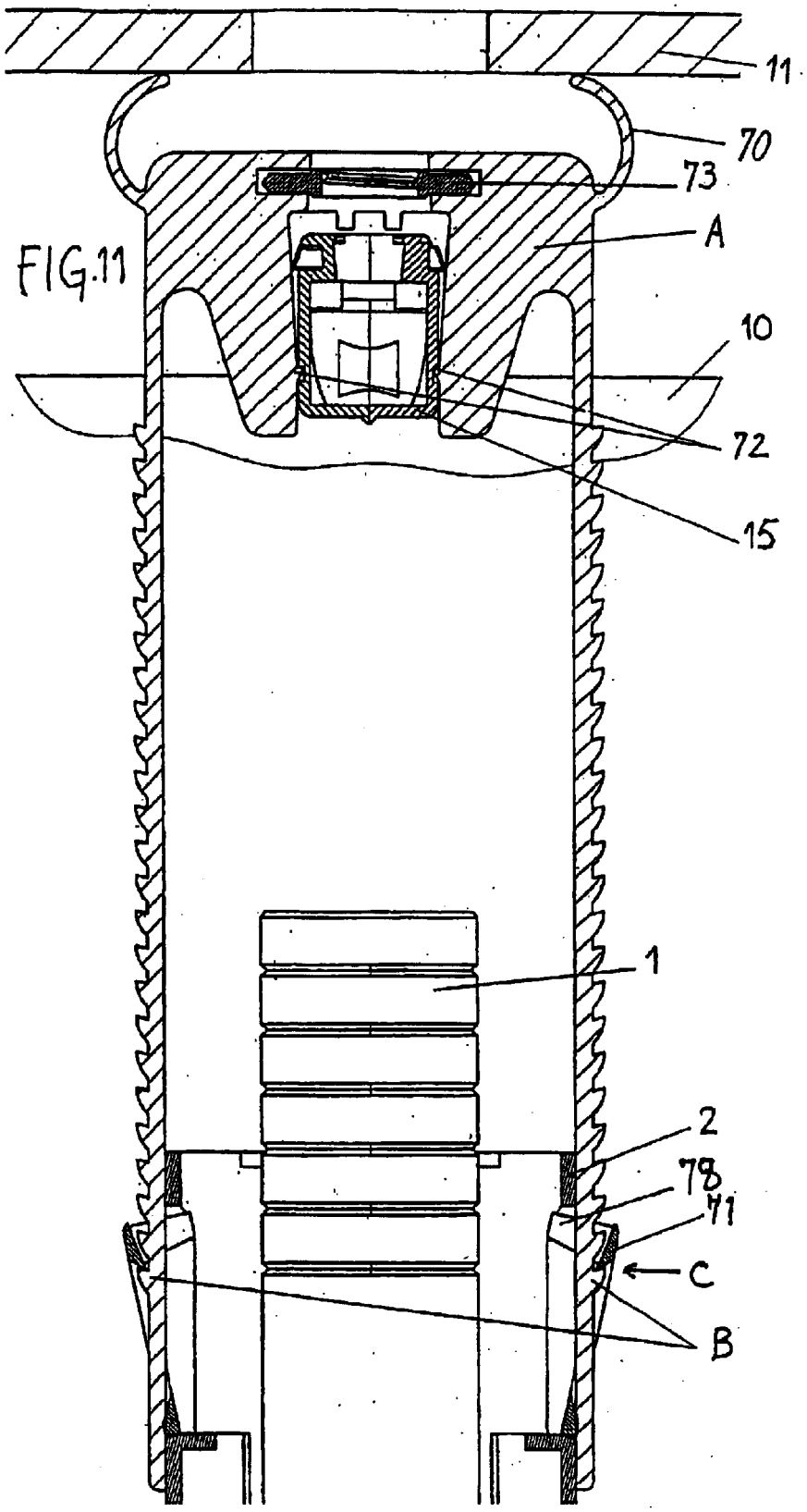
Figure 12:
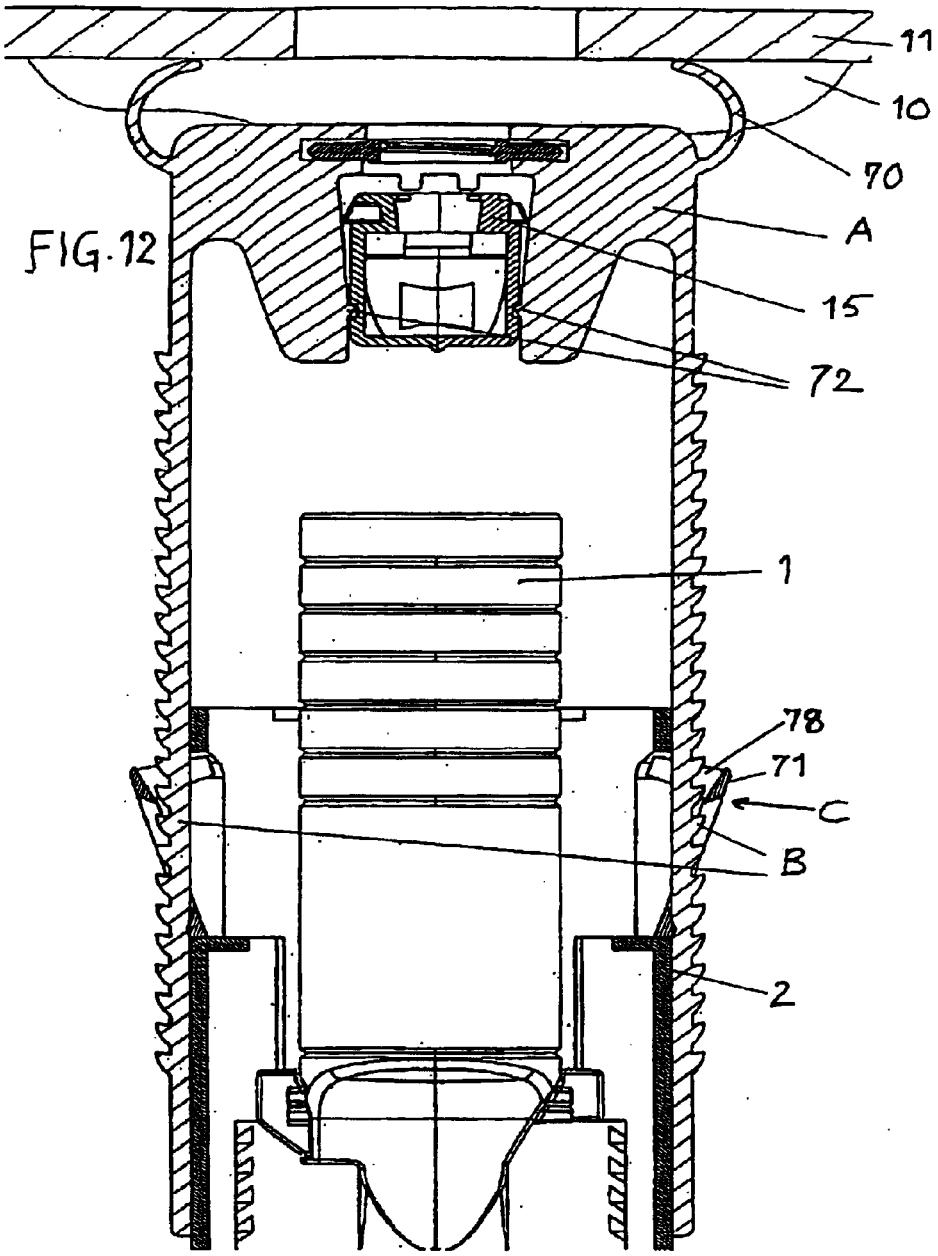
Figure 13:
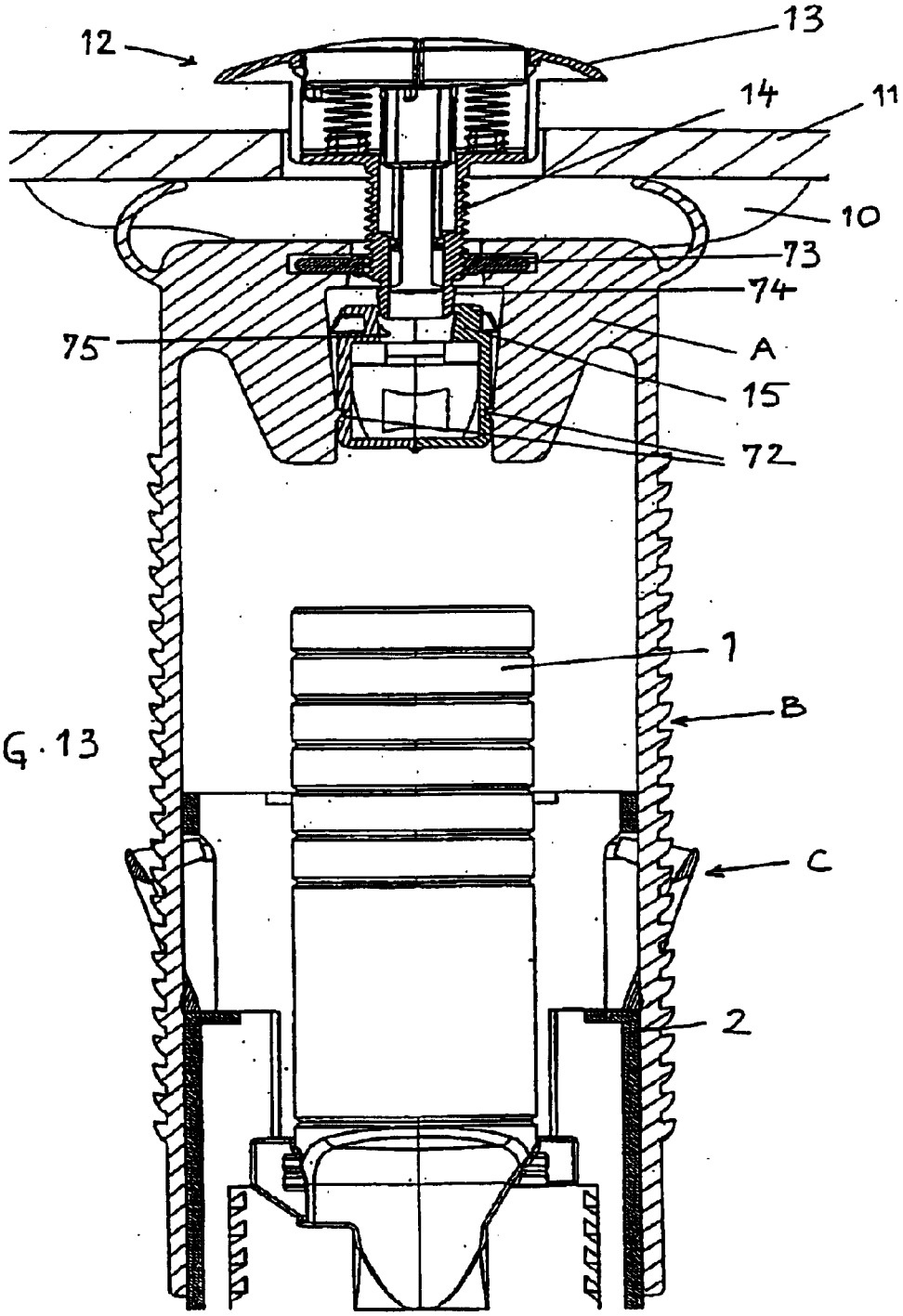
Figure 14:
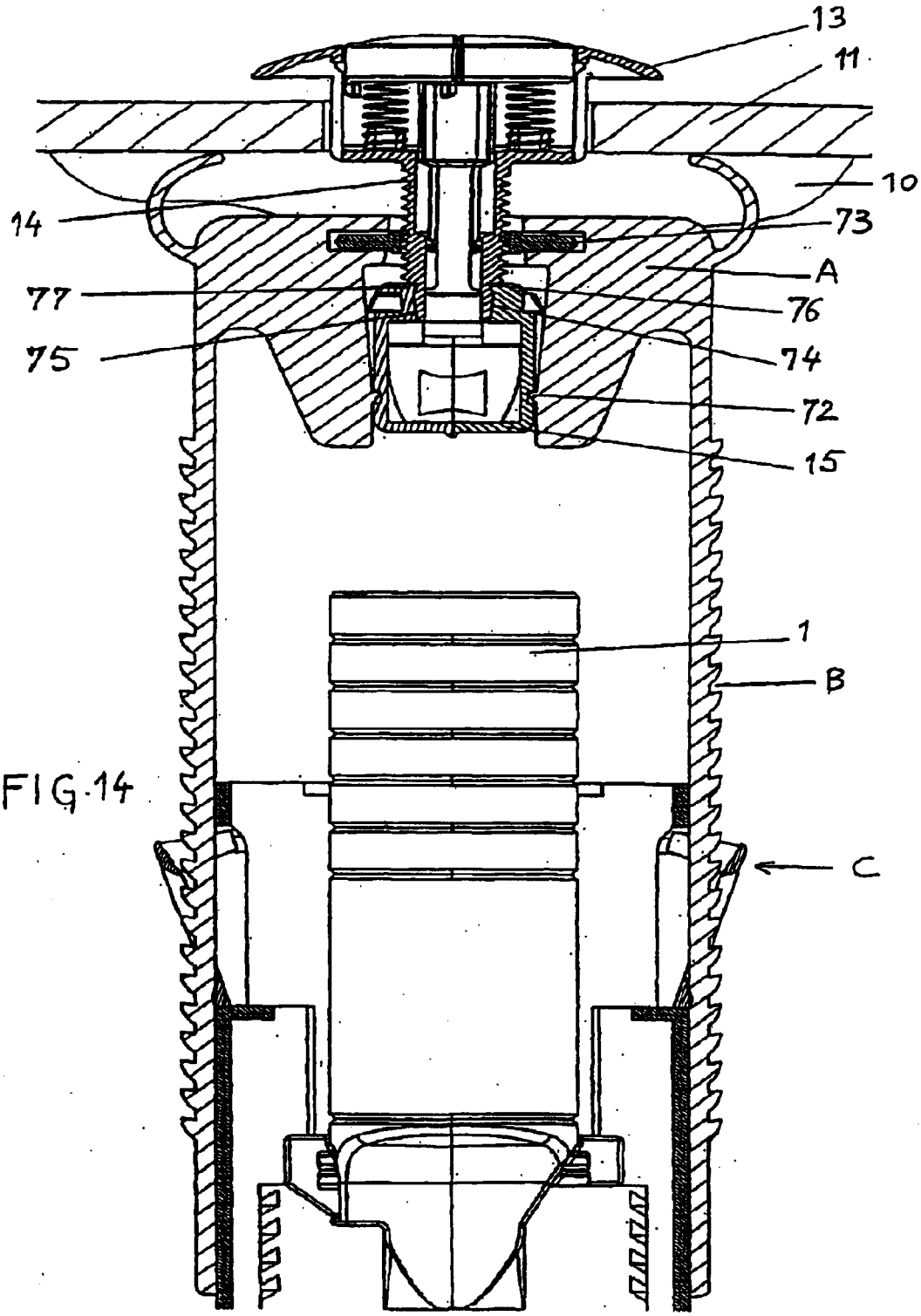
Figure 15:
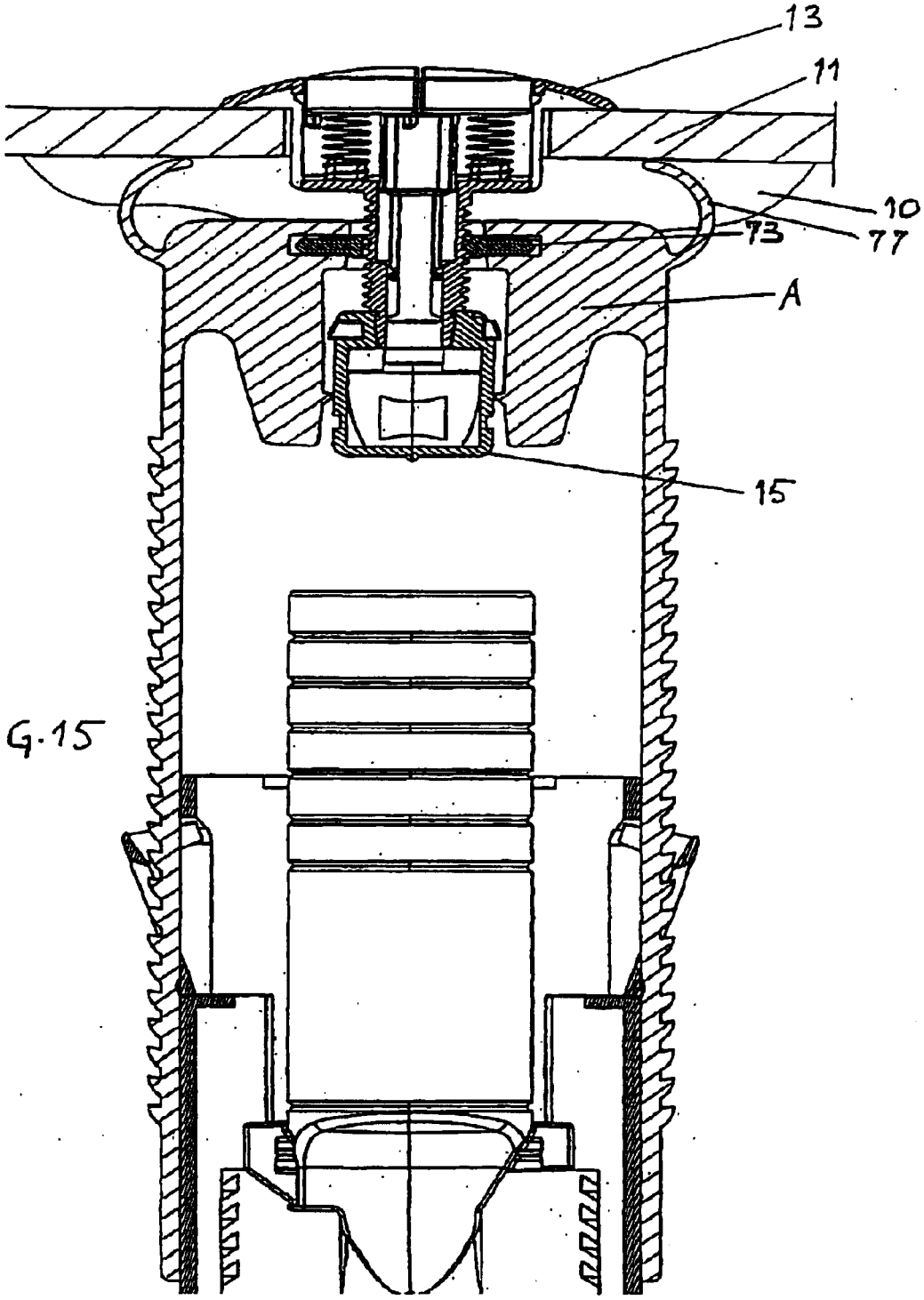
Figure 16:
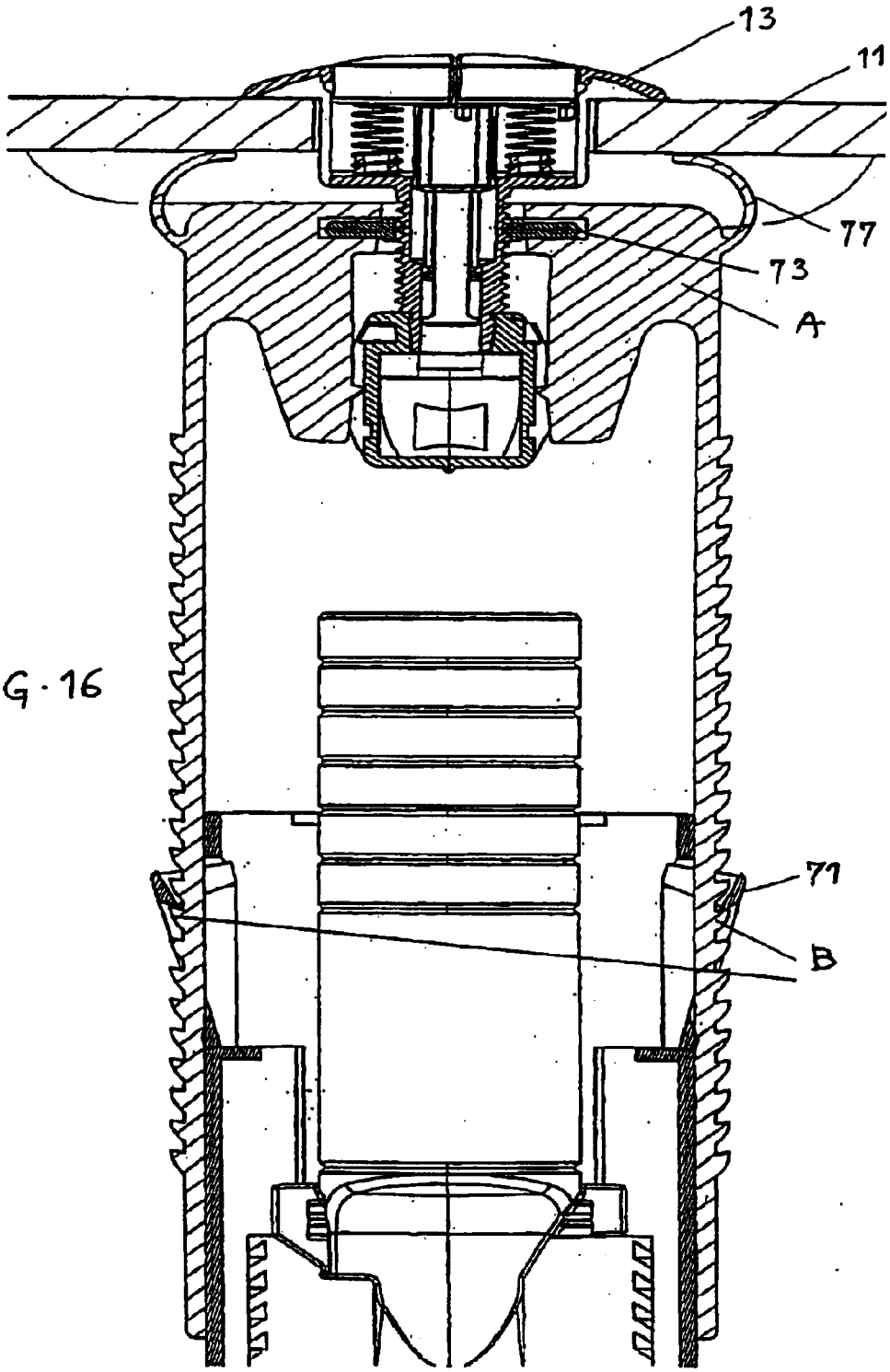
Figure 17:
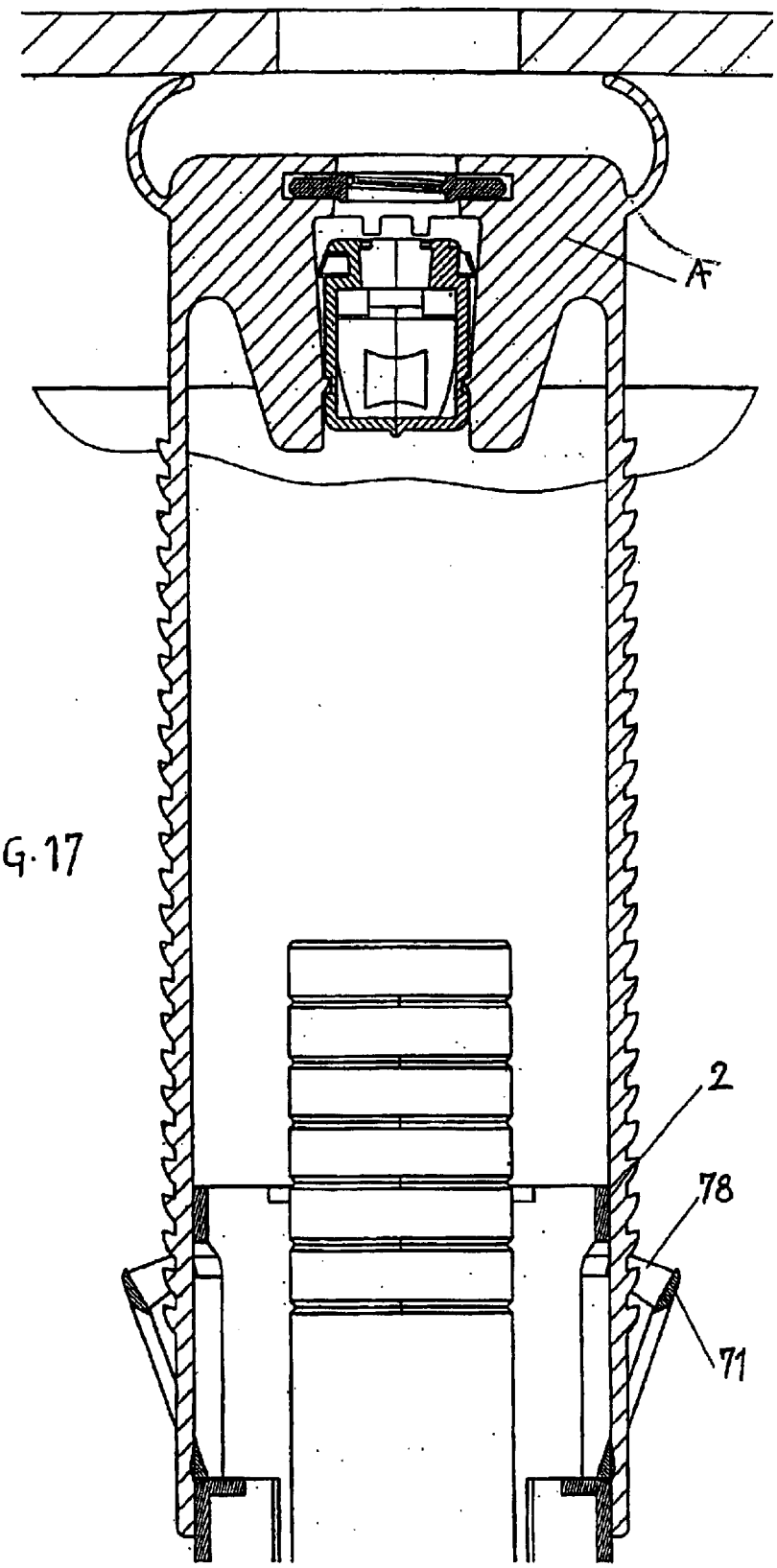

Other characteristics and advantages of the present invention will become apparent from the following description of one embodiment, with reference to the accompanying drawings, in which:

FIG. 1 is a schematic perspective view of the flushing mechanism mounted in a flush tank, the cover being secured to the tank by means of said flush mechanism, the cover and the tank being partially broken away for better understanding, FIG. 2 is similar to FIG. 1, the cover not being secured to the tank but simply disposed above it, FIG. 3 is a schematic elevational view of the flushing mechanism, the tank being full, the mechanism housing being supposed to be transparent, FIG. 4 is analogous to FIG. 3, the reservoir being empty, certain portions being represented in cross-section, FIG. 5 is similar to FIGS. 3 and 4, the mechanism being in the small flush position, FIG. 6 is analogous to FIG. 5, the mechanism being in the large flush position, FIG. 7 is a schematic perspective view of the mechanism of a portion of the control means, the cover being open, FIGS. 8, 9 and 10 show in perspective the double control button of the mechanism, respectively in the rest position, with the small flush button depressed and the large flush button depressed, FIGS. 11 to 16 show respectively the various phases of securement of the cover to the tank by means of the mechanism, and FIG. 17 shows a phase of disassembly of the preceding assembly.

The mechanism according to the invention comprises an overflow tube 1 mounted for translatory movement in a housing 2. The overflow tube 1 carries, at its lower end, a head 3 provided with a flat peripheral sealing joint 4, which forms a sealing valve coacting with a base 5 secured to the housing 2 by pillars 6.

This assembly is mounted within a tank 10 supplied with water by filling means (not shown) including a filling limitation member such as a float controlling a valve. The base 5 is disposed in a lower opening of the tank 10 such that, when the sealing valve 3, 4 is spaced from the base 5 forming a valve seat, the water contained in the tank 10 can flow into a toilet bowl (not shown).

The cover of the tank 10 (FIG. 1) can be secured to the tank by means of the flushing mechanism and a circular fitting 13 that carries control buttons 12 fixed to said cover. In the example according to FIG. 2, the housing 15 is simply fixed to the interior of the tank 10 below the circular fitting carrying the control buttons.

The button 12, whose structure and function will be explained in greater detail with reference to FIGS. 8 to 10, comprises an external circular fitting 13 that carries the control buttons, disposed in an opening of the cover and screwed by a screw-threaded projection 14 (FIGS. 8 to 10) on a housing 15. A sleeve 16 is in abutment at one end against the housing 15 and at the other end against the housing 2. A control cable 17 (see FIG. 7) is disposed in the sleeve 16.

In the case of securement of the cover 11 of the tank (FIG. 1), a stirrup A is fixed between the housing 15 and the cover 11 and its arms comprise notches B which coact each with a flexible attachment C secured to the housing 2, such that the emplacement of the cover 11 can take place by simple pressure of the arms in said flexible attachments C. This securement will be explained in greater detail with reference to FIGS. 11 to 17.

The overflow tube 1 comprises an external shoulder 20 with which coacts a nose 21 of a lever 22 pivoting about an axle 23 orthogonal to the direction of translation of the overflow tube 1, one end of the control cable 17 being fixed to the lever 22 such that pulling on the control cable 17 produces a raising of the overflow tube 1.

A small flush float 30 is mounted on a micrometer screw 31 for a fine adjustment as to height, which adjusts the quantity of water delivered. This screw comprises an upper screw head 32 and its lower end is provided with a swivel joint 33 for articulation of a lever 34 whose end opposite the swivel joint 33 is articulated about an axle 35 fixed relative to the housing 2. The lever 34 carries a lug 36 which coacts with a first cam 37 carried by the overflow tube 1. The adjustment screw 31 can preferably be of a sufficiently flexible material to permit initial emplacement of the small flush float 30, provided with a notch 30' (FIG. 4), by forcibly sinking down over the adjustment screw 31, the fine adjustment of the height-wise position of the small flush float 30 taking place conventionally by action on the screw head 32.

A large flush float 40, pivotal about an axle 41 fixed relative to the housing 2, is mounted on a side substantially diametrically opposed to the small flush float 30 relative to the overflow tube 1. The large flush float 40 is provided with a lug 42 which coacts with a second cam 43 carried by the overflow tube 1.

The operation of the mechanism which has been described is as follows:

When the tank 10 is full (FIG. 3) or when it is empty (FIG. 4), the valve 3, 4 bears against the seat of the base 5, such that communication between the tank 10 and the bowl is closed.

A small flush pull on the control cable 17 brings the overflow tube 1 to the small flush emptying position (FIG. 5) in which the small flush float 30 is raised, to a predetermined height, and the valve 3, 4 is spaced by a certain height from the seat of the base 5 and opens the passage between the tank 10 and the bowl. The lug 36 of the lever 34 has slid along the first cam 37 and comes to rest below a shoulder formed by this cam 37. The small flush float 30 thus locks the overflow tube 1 and does not free it until the water level in the tank has fallen by a height such that the small flush float 30 no longer floats on the water and re-descends, causing the lever 34 to pivot. The lug 36 thus escapes from the shoulder of the cam 37 and the overflow tube 1 abruptly returns downwardly, interrupting the emptying. The quantity of water emptied corresponds to the small flush.

A greater pull on the control cable 17 brings the overflow tube 1 to a higher position for emptying a large flush (FIG. 6). The lug 42 of the large flush float 40 comes to rest beneath a shoulder of the second cam 43, such that the large flush float 40 locks the overflow tube 1. As before, the overflow tube 1 is freed only when the water level in the tank 10 frees the large flush float 40 which, by pivoting, spaces the lug 42 from the cam 43. The overall tube 1 again falls abruptly to the closure position, the quantity of water emptied corresponding to the large flush.

The control of the traction on cable 17 according to these two different paths can take place in various ways.

According to a preferred embodiment of the invention shown in FIGS. 8 to 10, the button 12 comprises two sliding pushers 50 and 51 urged outwardly of the body 13 by springs 52 and 53 respectively. The pushers 50 and 51 each have an axial prolongation 54, 55 sliding in the screw-threaded projection 14, on opposite sides of a slide way 56 connected to the adjacent end of the cable 17. In the rest position (FIG. 8), the prolongations 54, 55 bear respectively against a lateral support 57, 58 of the slide way 56. By pressing down the small flush pusher 50 (FIG. 9), the slide way 56 descends under the action of the projection 54 on the support 57, along a predetermined path, whilst upon pushing down the large flush pusher 51 (FIG. 10), the slide way 56 descends along an upper path under the action of the projection 55 on the support 58. The slide way 56 is moreover provided with two lateral projections 59 coacting respectively with a shoulder 59' of the axial prolongations 54, 55 to hold the pusher 50, 51 inactive.

In the exemplary embodiment illustrated, the housing 2 of the mechanism is made of a single piece of polypropylene in two half shells articulated about a hinge 60 (FIG. 7) parallel to the axis of the overflow tube 1. The open housing 2 permits easily assembling all the components within it. Its closing ensures the positioning of all the elements.

Moreover, a flap with a slide 61 is mounted slidably on a lateral opening 61' provided in the portion of the housing 2 forming a retention basin for water so as to permit adjustment of the residual water level from 15 to 65 mm in the bottom of the housing 2, defining the retardation of closing of the valve 3, 4. Moreover, and as shown in FIGS. 5 and 7, a passage 62 provided in the lower portion of the overflow tube forms a passage for flow of water in the small flush position between the overflow tube 1 and the housing 2 which ensures a neutralization of the timing when the small flush float 30 is adjusted in the bottom of the housing 2. The height of the retention basin is determined by the inlets 63 provided in the housing 2, the lowermost inlet determining the magnitude of the delay time.

The mechanism which has been described moreover offers the advantage of permitting very low adjustment of the small flush, for operation with a minimum water level in the tank (100 mm for example). This result is obtained by the independence of the floats 30 and 40, the small flush float 30 being able to fall while crossing the large flush float 40.

In the illustrated example, the base 5 has no projecting seat and has an internal tulip shape 5 against which will come to bear the radius of 1 mm on the external diameter of the joint 4 of the valve head 3. The water flow and the flush flow rate are thus improved. Moreover, the force of opening the valve 3 is substantially reduced thanks to the decrease in cross-section of the water column which bears against the flat joint 4.

It will also be noted, that the device which has been described comprises a marking 65 guaranteeing a minimum evacuation level of 3 liters imposed by standards. This marking is disposed in the upper portion of the small flush float 30.

Reference will now be made to FIGS. 11 to 17, which show the securement of the cover 11 on the tank by means of the double flow mechanism, as shown in FIG. 1. The object sought and required by ceramic manufacturers is to avoid any complex adjustment of the mechanism during securement of the cover 11 on the tank 10.

In a first phase (FIG. 11), the cover 11 bears against the resilient tongues 70 which are present in the upper portion of the stirrup A, adapted to press this stirrup A downwardly. The lowermost notches B of the stirrup A are hooked to the gears with hinge 71 of the flexible attachment C secured to the housing 2. The housing 15 is temporarily immobilized by the notches 72 of the head of the stirrup A.

Then (see FIG. 12) the cover 11 is manually pressed to come into support against the top of the tank 10. The stirrup A descends and the hinged ears 71 come into position respectively on two notches B. The housing 15 is temporarily immobilized in the stirrup A by the notches 72.

Then (see FIG. 13) the circular fitting 13 carrying buttons 12 is screwed by its screw-threaded projection 14 into a nut 73 trapped in the head of the stirrup A. The screw-threaded projection 14 terminates in a conical end 74 which engages in a corresponding hollow conical portion 75 of the housing 15, which is still immobilized in the stirrup A by the notches 72.

Upon continued screwing of the circular fitting 13 into the nut 73 (FIG. 14), the circular fitting 13 is no longer in contact with the cover 11. At the connection between the conical portion 74 and the screw-threading of the screw-threaded projection 14 of the circular fitting 13 is provided a throat 76 in which engages a circular projection 77 of the hollow conical portion 75 of the housing 15, such that the circular fitting 13 becomes secured to the housing 15 which is still temporarily immobilized in the stirrup A by the notches 72.

Then, upon continued screwing of the circular fitting 13 into the nut 73 (FIG. 15), the circular fitting 13 drives the housing 15, which becomes freed from the stirrup A by leaving the notches 72. The circular fitting 13 then comes into contact with the cover 11.

The screwing of the circular fitting 13 into the nut 73 continues (see FIG. 16), so that the stirrup A approaches the cover 11 by deforming the resilient tongues 70. The notches B of the stirrup A positively hook to the hinged ears 71 and the cover 11 is thus finally fixed.

For disassembling the stirrup A (FIG. 17), after unscrewing and the exit of the circular fitting 13 and dismounting the cover 11, the hinged ears 71 are spaced, whose end cleats 78 hook on the housing 2 of the flushing mechanism. The stirrup A is thus disengaged and can be raised or withdrawn.

The securement of the cover 11 on the tank 10, by means of the flushing mechanism, is thus extremely simple and rapid and requires no particular or special adjustment.

What is claimed is:

1. Flushing mechanism for a toilet tank (10) arranged to permit the evacuation from the previously filled tank (10) of two different volumes of water by action on at least one control button (12), said mechanism comprising an overflow tube (1) provided, at its lower end, with a sealing valve (3, 4) coacting with an evacuation opening (5') provided in the bottom of the tank (10), said overflow tube (1) being arranged to occupy at least three axial positions, namely a lower position for closing the evacuation opening (5'), an intermediate so-called small flush position permitting evacuation of a first volume of water and an upper so-called large flush position permitting the evacuation of a second volume of water greater than the first volume of water, control means (12, 16, 17, 21, 22) ensuring the axial movement of the overflow tube (1) from its lowest position to the intermediate position or the upper position, the mechanism moreover comprising a first so-called small flush float (30) mounted on a height adjustment screw (31) and a second so-called large flush float (40) pivotally mounted about an axle (41) fixed relative to the housing (2), characterized in that a housing (2) surrounds the assembly of the mechanism, said housing (2) being of a single piece in two parts articulated about a hinge (60) parallel to the axis of the overflow tube (1).

2. Flushing mechanism according to claim 1, characterized in that the overflow tube (1) comprises a lateral shoulder (20), with which coacts a lever (21, 22) pivoting about an axle (23) orthogonal to the direction of movement of the overflow tube (1), said lever (21, 22) being controlled in rotation by a cable (17) in a sheath (16) whose one end is fixed to said lever (21, 22) and whose other end is fixed to a slide way (56) controlled along two different paths by a control button (12) with two positions.

3. Flushing mechanism according to claim 2, characterized in that said control button (12) comprises two slidable pushers (50, 51) urged outwardly by springs (52, 53), the pushers (50, 51) comprising axial prolongations (54, 55) disposed on opposite sides of said slide way (56) and coacting by bearing respectively against a lateral support (57, 58) of the slide way (56).

4. Flushing mechanism according to claim 1, characterized in that the adjustment screw (31) is articulateted (33) in the vicinity of its lower end, on one end of a lever (34) whose other end is articulated about an axle (35) fixed relative to the housing (2).

5. Flushing mechanism according to claim 1, characterized in that a base (5) mounted in the bottom of the tank (10) has no projecting seat and has an internal, tulip shape (5') against which comes to bear the radius located on the external diameter of a flat joint (4) constituting with a head (3) the sealing valve.

6. Flushing mechanism according to claim 1, characterized in that the housing (2) comprises inlets (63) delimiting a retention basin for water in the bottom of the housing (2).

7. Flushing mechanism according to claim 6, characterized in that a flap with a slide (61) is mounted slidably on the lateral opening (61') provided in the portion of the housing (2) forming a retention basis to permit adjustment of the residual water level.

8. Flushing mechanism according to claim 1, characterized in that the overflow tube (1) comprises at its lower portion a passage (62) forming a flow passage for water in the small flush position between the overflow tube (1) and the housing (2).

9. Flushing mechanism according to claim 1, characterized in that the adjustment screw (31) is constituted of a flexible material permitting forcibly sinking the small flush float (30) comprising a notch (30') coacting with said adjustment screw (31).

10. Flushing mechanism according to claim 1, characterized in that a stirrup (A) is fixed between the housing (15) and the cover (11) of the tank (10) and comprises two arms provided with notches (B) each coacting with a flexible attachment (C) secured to the housing (2) of the mechanism.

11. Flushing mechanism according to claim 10, characterized in that the stirrup (A) is provided with resilient tongues (70) for support of the cover (11) and with notches (72) for immobilizing a housing (15) arranged to be fixed to the end of a screw-threaded projection (14) of a circular fitting (13) that carries buttons (12), said screw-threaded projection (14) coacting with a nut (73) trapped in stirrup (A), said housing (15) comprising a circular projection (77) coacting with a throat (76) of the screw-threaded projection (14), said screw-threaded projection (14) having a conical end (74) coacting with a corresponding hollow conical portion (75) of the housing (15).

12. Flushing mechanism according to claim 1, characterized in that it comprises a mark (65) disposed in the upper portion of the small flush float (30) and guaranteeing a predetermined minimum evacuation volume.

* * * * *